US009207555B1

(12) United States Patent
Hoy et al.

(10) Patent No.: US 9,207,555 B1
(45) Date of Patent: Dec. 8, 2015

(54) CHARGE ROLL MOUNTING ASSEMBLY FOR AN ELECTROPHOTOGRAPHIC IMAGE FORMING DEVICE

(71) Applicant: Lexmark International, Inc., Lexington, KY (US)

(72) Inventors: Ahren Michael Hoy, Lexington, KY (US); Michael David Maul, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/288,760

(22) Filed: May 28, 2014

(51) Int. Cl.
*G03G 15/02* (2006.01)

(52) U.S. Cl.
CPC ..... *G03G 15/0216* (2013.01)

(58) Field of Classification Search
CPC ..... G03G 15/0216; G03G 15/0223; G03G 21/184; G03G 2221/1693
USPC ..... 399/115, 111
See application file for complete search history.

(56) References Cited

U.S. PATENT DOCUMENTS

| | | | | |
|---|---|---|---|---|
| 5,845,177 | A * | 12/1998 | Choi | 399/115 |
| 6,508,601 | B1 * | 1/2003 | Lui et al. | 399/111 X |
| 7,480,474 | B2 * | 1/2009 | Muto | 399/115 X |
| 8,204,400 | B2 * | 6/2012 | Karasawa et al. | 399/115 X |
| 2010/0104320 | A1 * | 4/2010 | Moon et al. | 399/115 |
| 2012/0141163 | A1 * | 6/2012 | Pitas et al. | 399/115 |

* cited by examiner

*Primary Examiner* — Sophia S Chen
(74) *Attorney, Agent, or Firm* — Justin M Tromp

(57) ABSTRACT

An assembly for an electrophotographic image forming device according to one example embodiment includes a charge roll and a bracket that extends along an axial length of the charge roll. First and second bearing retainers are positioned on a first axial end and a second axial end of the bracket, respectively. First and second bearings are pivotally mounted to the first and second bearing retainers, respectively. Each of the first and second bearings has a charge roll opening that supports a respective axial end of a shaft of the charge roll. First and second biasing members act on the first and second bearings, respectively. The first and second biasing members bias the charge roll toward an operative position for charging a photoconductive drum. A direction of force from the first biasing member on the first bearing and from the second biasing member on the second bearing is toward the bracket.

17 Claims, 8 Drawing Sheets

CHARGE ROLL MOUNTING ASSEMBLY FOR AN ELECTROPHOTOGRAPHIC IMAGE FORMING DEVICE

CROSS REFERENCES TO RELATED APPLICATIONS

None.

BACKGROUND

1. Field of the Disclosure

The present invention relates generally to electrophotographic image forming devices and more particularly to a charge roll mounting assembly for an electrophotographic image forming device.

2. Description of the Related Art

As is well known in the art, during a print operation by an electrophotographic image forming device a charge roll charges the surface of a photoconductive drum to a predetermined voltage. The charged surface of the photoconductive drum is then selectively exposed to a laser light source to selectively discharge the surface of the photoconductive drum and form an electrostatic latent image on the photoconductive drum corresponding to the image being printed. Toner is picked up by the latent image on the photoconductive drum from a developer roll (in the case of single component development printing) or a magnetic roll (in the case of dual component development printing) creating a toned image on the surface of the photoconductive drum. The toned image is then transferred from the photoconductive drum to the print media either directly by the photoconductive drum or indirectly by an intermediate transfer member. A cleaning blade or roller removes any residual toner adhering to the photoconductive drum after the toner is transferred from the photoconductive drum. The cleaned surface of the photoconductive drum is then ready to be charged again and exposed to the laser light source to continue the printing cycle.

The charge roll is preferably biased uniformly along the axial length of the charge roll against the surface of the photoconductive drum to provide uniform charging across the axial length of the photoconductive drum. If the charge roll bias is uneven, print defects may occur. For example, if the charge roll does not make enough contact at the axial ends of the photoconductive drum for proper charging, dark spots will occur at the edges of the printed page. On the other hand, if the charge roll has too much bias at the axial ends of the photoconductive drum, light or feathered printing will occur at the edges of the printed page. The charge roll is often driven by friction from the nip formed between the charge roll and the photoconductive drum. If the nip force is too low, the charge roll may slip against the surface of the photoconductive drum resulting in dark bands on the printed page. During long periods of inactivity, such as during shipping or storage of the image forming device or a replaceable unit containing the charge roll and photoconductive drum, a flat spot may be formed on the surface of the charge roll where it contacts the photoconductive drum due to compression of the charge roll at that location. When printing resumes, the flat spot causes a temporary spike in the load to the charge roll that can't be overcome if the nip force is too low until after the image forming device operates long enough for the charge roll to regain its original shape. Further, excessive vibration of the charge roll during operation may cause light or dark bands on the printed page as a result of the charge roll momentarily having a bias that is too high or too low as it vibrates.

FIGS. 1 and 2 show a prior art charge roll mounting assembly 20. Assembly 20 includes a cleaner bracket 22 having a rear plate 24 and a top plate 26 that each extend in a lengthwise direction 28 corresponding with the axial direction of the photoconductive drum (FIG. 3). Top plate 26 extends forward and upward from rear plate 24. Rear plate 24 and top plate 26 are formed integrally with each other from electrogalvanized steel sheet. A cleaner blade 30 extends in a cantilevered manner downward from rear plate 24. A free end 32 of cleaner blade 30 is positioned to contact the surface of the photoconductive drum to remove residual toner from the photoconductive drum.

A charge roll 34 is mounted to cleaner bracket 22 in position to contact the surface of the photoconductive drum to charge the surface of the photoconductive drum. A cleaner roll 36 is mounted against charge roll 34 to clean toner from the surface of charge roll 34. Charge roll 34 includes a shaft 35 and cleaner roll 36 includes a shaft 37. Cleaner roll 36 is driven by friction from the nip formed between charge roll 34 and cleaner roll 36. The axial ends of shafts 35 and 37 are retained by bearings 38A, 38B. Specifically, each bearing 38A, 38B includes a charge roll opening 40A, 40B that receives an axial end of shaft 35 and a cleaner roll opening 42A, 42B that receives an axial end of shaft 37. Openings 40A, 40B, 42A, 42B are generally cylindrical in shape and formed by bearing surfaces for shafts 35 and 37 of charge roll 34 and cleaner roll 36 to rotate against. The distance between openings 40A and 42A and between openings 40B and 42B define the positional relationship between charge roll 34 and cleaner roll 36 to achieve the desired nip force between charge roll 34 and cleaner roll 36. Cleaner roll openings 42A, 42B are spaced axially inward from charge roll openings 40A, 40B due to the shaft of cleaner roll 36 having a shorter length than the shaft of charge roll 34.

A cast zinc bearing retainer 44A, 44B mounts each bearing 38A, 38B to cleaner bracket 22 on inner axial sides of bearing retainers 44A, 44B. Each bearing retainer 44A, 44B includes a rectangular slot 46A, 46B that slips over a corresponding flange 48A, 48B formed at each end of top plate 26 to align bearing retainers 44A, 44B with cleaner bracket 22. Bearing retainers 44A, 44B and rear plate 24 of cleaner bracket 22 have corresponding screw holes 50A, 50B and 52A, 52B that receive a screw at each end of cleaner bracket 22 to fix bearing retainers 44A, 44B to cleaner bracket 22 and cleaner bracket 22 to a housing of the image forming device or a housing of a replaceable unit of the image forming device. Bearing retainer 44B includes a fixed pin 56 that extends axially inward that retains bearing 38B on bearing retainer 44B. Bearing retainer 44A includes a guide slot 58 in substantially the same position on bearing retainer 44A as pin 56 on bearing retainer 44B. Guide slot 58 receives a locking pin 60 that retains bearing 38A on bearing retainer 44A as discussed in greater detail below.

FIG. 3 shows an end view of bearing 38A positioned relative to cleaner bracket 22 with bearing retainer 44A removed to more clearly illustrate the features of bearing 38A. Bearing 38B is substantially the same as bearing 38A except that bearing 38B is a mirror image of bearing 38A. Each bearing 38A, 38B includes an arm 62 that extends forward, away from rear plate 24, from the portion of the bearing 38A, 38B that forms charge roll opening 40A, 40B. An opening 64 is formed in a distal end of arm 62. Opening 64 of bearing 38B receives pin 56 of bearing retainer 44B and opening 64 of bearing 38A receives locking pin 60. Each bearing 38A, 38B is pivotally mounted to its bearing retainer 44A, 44B and cleaner bracket 22 about a pivot point 66 at the center of opening 64. A compression spring 68A, 68B is positioned between each flange 48A, 48B of top plate 26 and a ledge 70 formed on a top surface of arm 62. Each ledge 70 includes a small finger 72 extending from ledge 70 that fits inside the end of compression spring 68A, 68B that is positioned against ledge 70 to position the end of compression spring 68A, 68B nearest ledge 70. A spring screw 74A, 74B passes through a screw hole 76A, 76B in each flange 48A, 48B and into the end of compression spring 68A, 68B that is positioned against flange 48A, 48B to position the end of compression spring 68A, 68B nearest flange 48A, 48B. Compression springs 68A, 68B bias bearings 38A, 38B about pivot point 66 toward a photoconductive drum 33 (in a counterclockwise direction as viewed in FIG. 3). Charge roll 34 and cleaner roll 36 move about pivot point 66 as a result of their engagement with charge roll openings 40A, 40B and cleaner roll openings 42A, 42B of bearings 38A, 38B. In this manner, the force from compression springs 68A, 68B biases charge roll 34 against photoconductive drum 33.

When charge roll mounting assembly 20 is installed in the image forming device and positioned relative to photoconductive drum 33, photoconductive drum 33 applies a force on charge roll 34 in the direction of the arrow 78 shown in FIG. 3. The force from photoconductive drum 33 on charge roll 34 compresses compression springs 68A, 68B from their home positions causing bearings 38A, 38B to pivot away from photoconductive drum 33 (in the clockwise direction as viewed in FIG. 3), in turn, displacing charge roll 34 from its home position to a position biased against the outer surface of photoconductive drum 33.

FIG. 4 shows locking pin 60 in greater detail. Locking pin 60 includes a handle 80 that includes a relatively wide base 82 and a narrower flange 84 that extends from base 82. A rectangular prism shaped rod 86 extends away from base 82 of handle 80 in a direction generally orthogonal to handle 80. The rectangular cross section of rod 86 is defined by a height and a width. The height is too large to fit through a channel 59 at the front of bearing retainer 44A that forms an entrance to guide slot 58 but the width is small enough to pass through channel 59 in order to permit locking pin 60 to be removed from bearing retainer 44A as discussed below. Rod 86 leads to a cylindrical spacer 88. A cylindrical pin 90 extends from spacer 88 away from handle 80. Spacer 88 is concentric with rod 86 and pin 90 and has a diameter that is larger than the height and width of rod 86 and the diameter of pin 90. The portion of spacer 88 that extends radially beyond the outer surface of rod 86 is spaced from handle 80 by the length of rod 86 in the axial direction of charge roll 34. A retaining bump 92 extends slightly outward from flange 84 in the same direction as rod 86 and pin 90. With reference to FIGS. 1-4, pin 90 is positioned in opening 64 on arm 62 of bearing 38A. The engagement between pin 90 and opening 64 of bearing 38A controls the position of pivot point 66 of bearing 38A relative to bearing retainer 44A. Rod 86 is positioned in guide slot 58 of bearing retainer 44A with bearing retainer 44A sandwiched between spacer 88 and base 82 of handle 80 to position locking pin 60 axially relative to bearing retainer 44A. Retaining bump 92 extends into a corresponding opening 94 in bearing retainer 44A that is positioned above guide slot 58. The engagement between positioning bump 92 and opening 94 prevents locking pin 60 from rotating relative to bearing retainer 44A. When positioning bump 92 is positioned in opening 94, rod 86 is oriented with its height aligned with channel 59 such that rod 86 cannot slide out of guide slot 58 and locking pin 60 cannot separate from bearing retainer 44A.

Locking pin 60 is manually installable onto and removable from charge roll mounting assembly 20 to aid in the installation and removal of charge roll 34 and cleaner roll 36 onto and off of cleaner bracket 22. To remove locking pin 60, a user pulls flange 84 of handle 80 away from bearing retainer 44A until positioning bump 92 pulls out of opening 94. Locking pin 60 is then free to rotate relative to bearing retainer 44A until the width of rod 86 is aligned with channel 59 so that rod 86 can slide out of guide slot 58 and locking pin 60 can separate from bearing retainer 44A. Pin 90 can then be removed from opening 64 on arm 62 of bearing 38A. To reengage locking pin 60 with bearing 38A, this sequence is reversed.

SUMMARY

An assembly for an electrophotographic image forming device according to one example embodiment includes a charge roll having a shaft that includes a pair of axial ends. The charge roll has an axial length between the axial ends of the shaft. A bracket extends along the axial length of the charge roll. A first bearing retainer is positioned on a first axial end of the bracket and a second bearing retainer is positioned on a second axial end of the bracket. A first bearing is pivotally mounted to the first bearing retainer and a second bearing is pivotally mounted to the second bearing retainer. Each of the first and second bearings has a charge roll opening that supports a respective axial end of the shaft of the charge roll. A first biasing member acts on the first bearing and a second biasing member acts on the second bearing. The first and second biasing members bias the charge roll toward an operative position for charging an outer surface of a photoconductive drum. A direction of force from the first biasing member on the first bearing and from the second biasing member on the second bearing is toward the bracket.

An assembly for an electrophotographic image forming device according to another example embodiment includes a photoconductive drum and a charge roll having a shaft that includes a pair of axial ends. The charge roll has an axial length between the axial ends of the shaft. A bracket extends along the axial length of the charge roll. The bracket has a rear plate positioned rearward from the charge roll and a top plate positioned above the charge roll. The top plate extends from a top portion of the rear plate in a forward direction away from the rear plate. A first bearing retainer is positioned on a first axial end of the bracket and a second bearing retainer is positioned on a second axial end of the bracket. A first bearing is pivotally mounted to the first bearing retainer and positioned on an inner axial side of the first bearing retainer and a second bearing is pivotally mounted to the second bearing retainer and positioned on an inner axial side of the second bearing retainer. Each of the first and second bearings has a charge roll opening that supports a respective axial end of the shaft of the charge roll. A first biasing member is in contact with the first bearing and a second biasing member is in contact with the second bearing. The first and second biasing members bias the charge roll toward an outer surface of the photoconductive drum. A direction of force from the first biasing member on the first bearing and from the second biasing member on the second bearing is toward the rear plate.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 7:
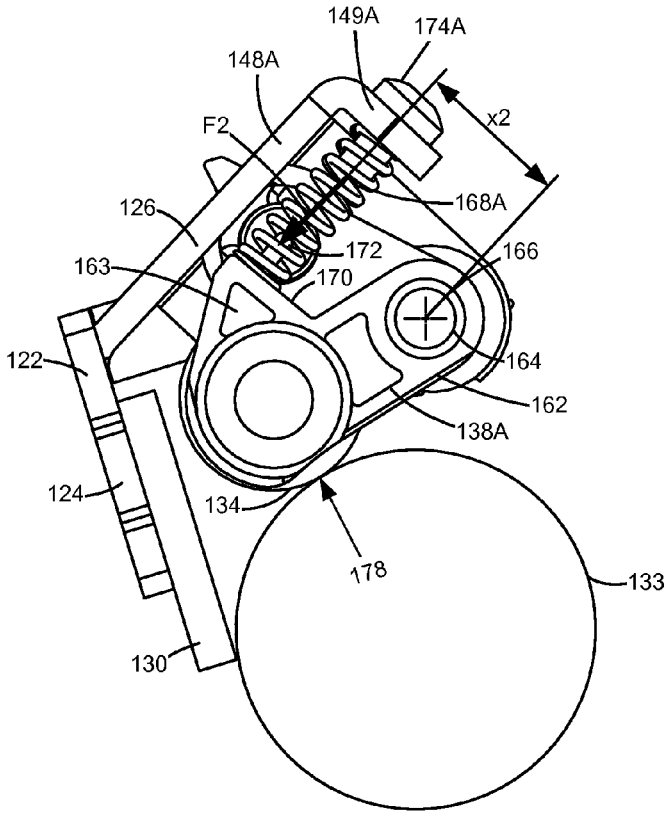
FIG. 7 is an end view of a bearing of the charge roll mounting assembly shown in FIG. 5 positioned relative to the cleaner bracket.
Figure 5:
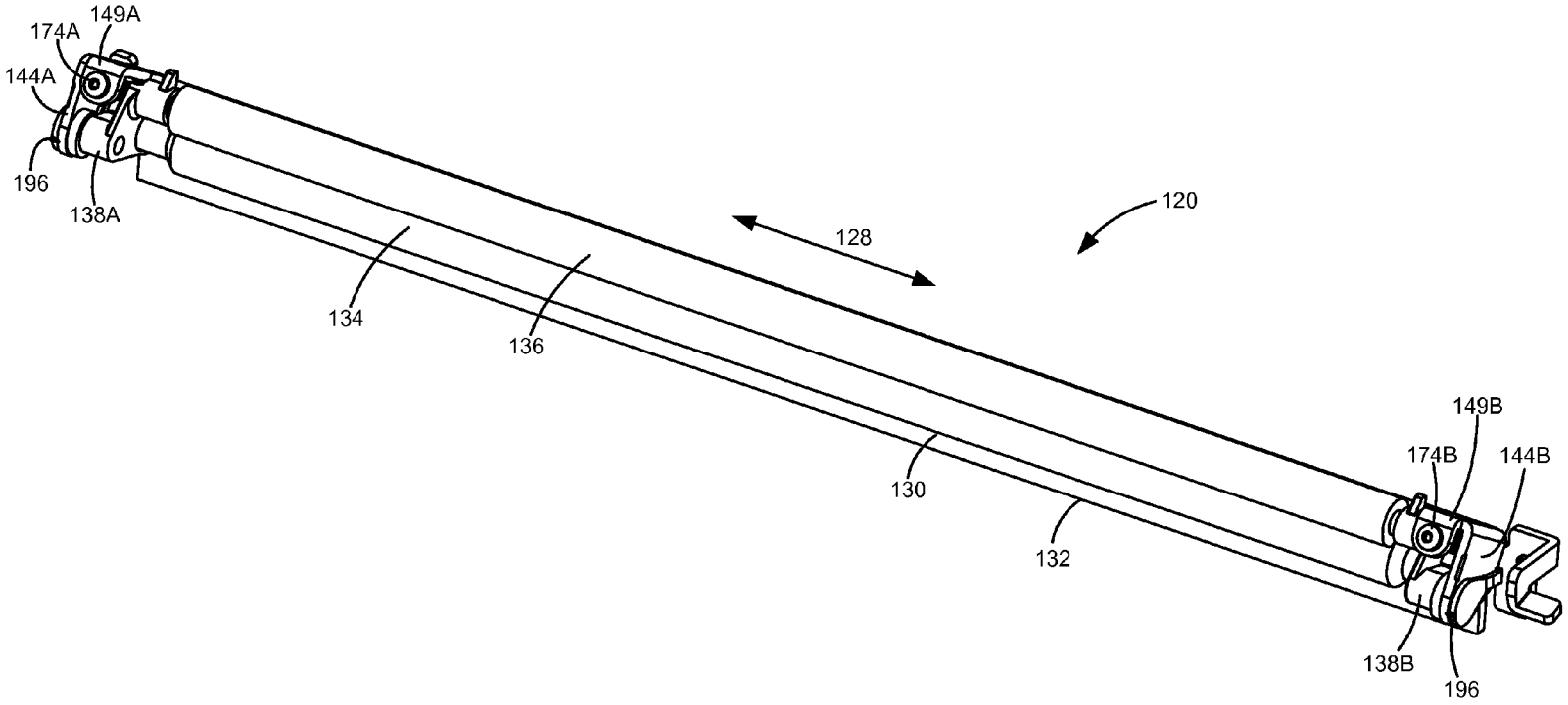
FIG. 5 is a perspective view of a charge roll mounting assembly according to one example embodiment.
Figure 6:
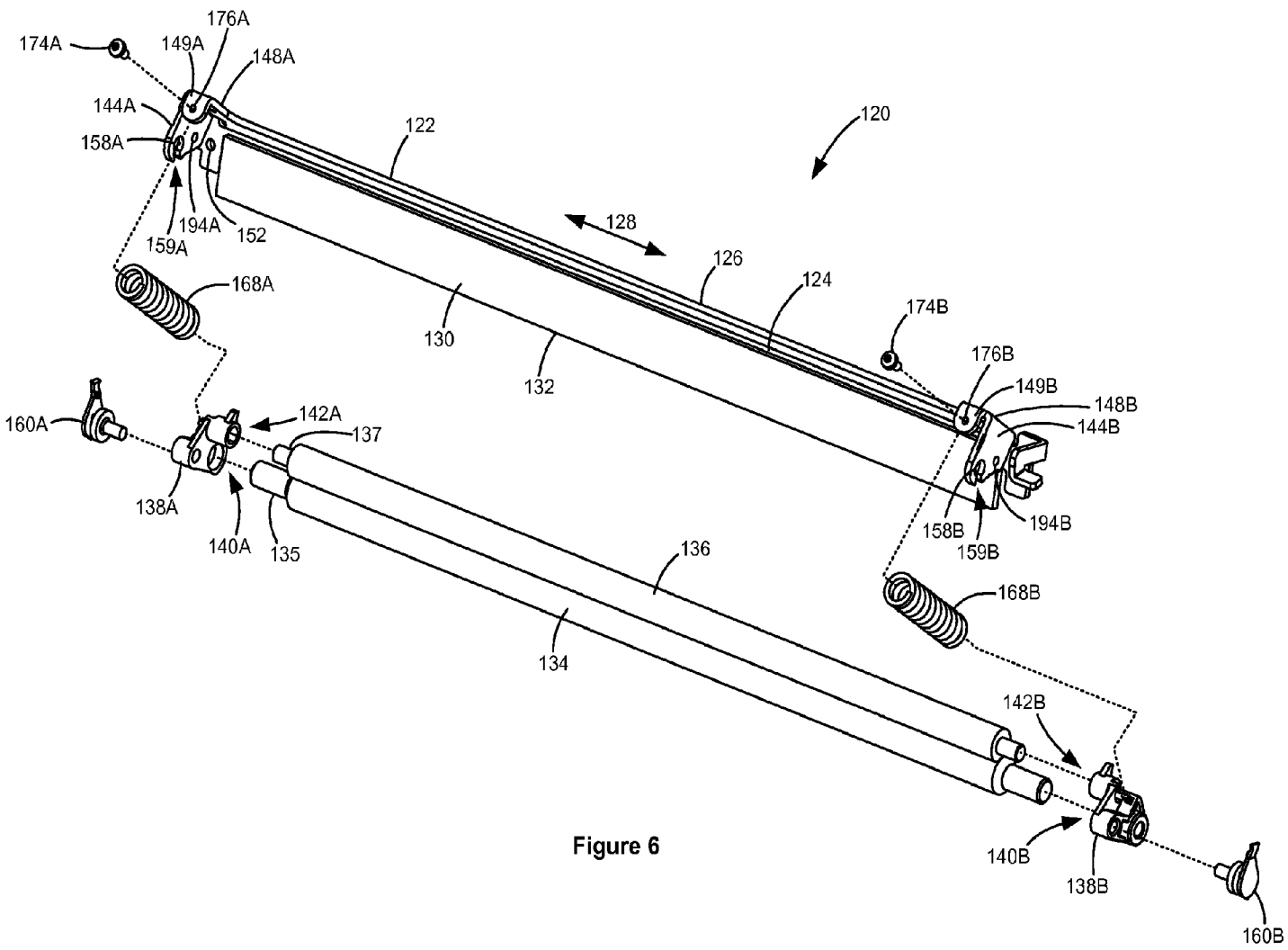
FIG. 6 is an exploded view of the charge roll mounting assembly shown in FIG. 5.

FIGS. 5 and 6 show a charge roll mounting assembly 120 according to one example embodiment. Assembly 120 includes a cleaner bracket 122 having a rear plate 124 and a top plate 126 that each extend in a lengthwise direction 128 corresponding with the axial direction of the photoconductive drum (FIG. 7). Top plate 126 extends forward and upward from rear plate 124. Rear plate 124 has screw holes 152 that receive a screw at each end of cleaner bracket 122 to fix cleaner bracket 122 to a housing of the image forming device or a housing of a replaceable unit of the image forming device (the screw hole 152 at the right end of rear plate 124 as viewed in FIG. 6 is obscured but is substantially the same as the screw hole 152 shown at the left end of rear plate 124). A cleaner blade 130 extends in a cantilevered manner downward from rear plate 124. A free end 132 of cleaner blade 130 is positioned to contact the surface of the photoconductive drum to remove residual toner from the photoconductive drum.

A charge roll 134 is mounted to cleaner bracket 122 in position to contact the surface of the photoconductive drum to charge the surface of the photoconductive drum. A cleaner roll 136 is mounted against charge roll 134 to clean toner from the surface of charge roll 134. Charge roll 134 includes a shaft 135 and cleaner roll 136 includes a shaft 137. Cleaner roll 136 is driven by friction from the nip formed between charge roll 134 and cleaner roll 136. The axial ends of shafts 135 and 137 are retained by bearings 138A, 138B. Bearings 138A, 138B may be composed of a suitable bearing plastic. Specifically, each bearing 138A, 138B includes a charge roll opening 140A, 140B that receives an axial end of shaft 135 and a cleaner roll opening 142A, 142B that receives an axial end of shaft 137. Openings 140A, 140B, 142A, 142B are generally cylindrical in shape and formed by bearing surfaces for shafts 135 and 137 of charge roll 134 and cleaner roll 136 to rotate against. The distance between openings 140A and 142A and between openings 140B and 142B define the positional relationship between charge roll 134 and cleaner roll 136 to achieve the desired nip force between charge roll 134 and cleaner roll 136. Cleaner roll openings 142A, 142B are spaced axially inward from charge roll openings 140A, 140B due to the shaft of cleaner roll 136 having a shorter length than the shaft of charge roll 134.

Top plate 126 includes a flange 148A, 148B at each end that extends forward and upward from top plate 126. A distal end of each flange 148A, 148B includes a mounting tab 149A, 149B that curves downward and forward as it advances away from top plate 126. A screw hole 176A, 176B is formed in each tab 149A, 149B. A bearing retainer 144A, 144B extends downward from an outer axial side of each flange 148A, 148B. In this embodiment, rear plate 124, top plate 126, including flanges 148A, 148B and tabs 149A, 149B, and bearing retainers 144A, 144B are formed integrally from a suitable metal such as electrogalvanized steel sheet. Bearing retainers 144A, 144B mount bearings 138A, 138B to cleaner bracket 122 on inner axial sides of bearing retainers 144A, 144B. Bearing retainers 144A, 144B each include a guide slot 158A, 158B that receives a corresponding locking pin 160A, 160B that retains bearings 138A, 138B on bearing retainers 144A, 144B as discussed in greater detail below.

FIG. 7 shows an end view of bearing 138A positioned relative to cleaner bracket 122 with bearing retainer 144A removed to more clearly illustrate the features of bearing 138A. Bearing 138B is substantially the same as bearing 138A except that bearing 138B is a mirror image of bearing 138A. Each bearing 138A, 138B includes an arm 162 that extends forward, away from rear plate 124, from the portion of the bearing 138A, 138B that forms charge roll opening 140A, 140B. An opening 164 is formed in a distal end of arm 162. Opening 164 of each bearing 138A, 138B receives the corresponding locking pin 160A, 160B. Each bearing 138A, 138B is pivotally mounted to its bearing retainer 144A, 144B of cleaner bracket 122 about a pivot point 166 at the center of opening 164. Each bearing 138A, 138B includes a flange 163 that extends upward from the portion of the bearing 138A, 138B that forms charge roll opening 140A, 140B in a position next to and axially outward from the cleaner roll opening 142A, 142B. Each flange 163 includes a ledge 170 formed on a front face thereof above charge roll opening 140A, 140B. A compression spring 168A, 168B is positioned between distal end 149A, 149B of each flange 148A, 148B of top plate 126 and ledge 170 formed on flange 163 of bearings 138A, 138B. Each ledge 170 includes a small finger 172 extending from the front face of ledge 170 that fits inside the end of compression spring 168A, 168B that is positioned against ledge 170 to position the end of compression spring 168A, 168B nearest ledge 170. A spring screw 174A, 174B passes through screw hole 176A, 176B in each flange 148A, 148B at distal ends 149A, 149B of flanges 148A, 148B and into the end of compression spring 168A, 168B that is positioned against flange 148A, 148B to position the end of compression spring 168A, 168B nearest flange 148A, 148B. Compression springs 168A, 168B bias bearings 138A, 138B about pivot point 166 toward a photoconductive drum 133 (in a counterclockwise direction as viewed in FIG. 7). Charge roll 134 and cleaner roll 136 move about pivot point 166 as a result of their engagement with charge roll openings 140A, 140B and cleaner roll openings 142A, 142B of bearings 138A, 138B. In this manner, the force from compression springs 168A, 168B biases charge roll 134 against photoconductive drum 133.

When charge roll mounting assembly 120 is installed in the image forming device and positioned relative to photoconductive drum 133, photoconductive drum 133 applies a force on charge roll 134 in the direction of the arrow 178 shown in FIG. 7. The force from photoconductive drum 133 on charge roll 134 compresses compression springs 168A, 168B from their home positions causing bearings 138A, 138B to pivot away from photoconductive drum 133 (in the clockwise direction as viewed in FIG. 7), in turn, displacing charge roll 134 from its home position to a position biased against the outer surface of photoconductive drum 133.

Figure 3:
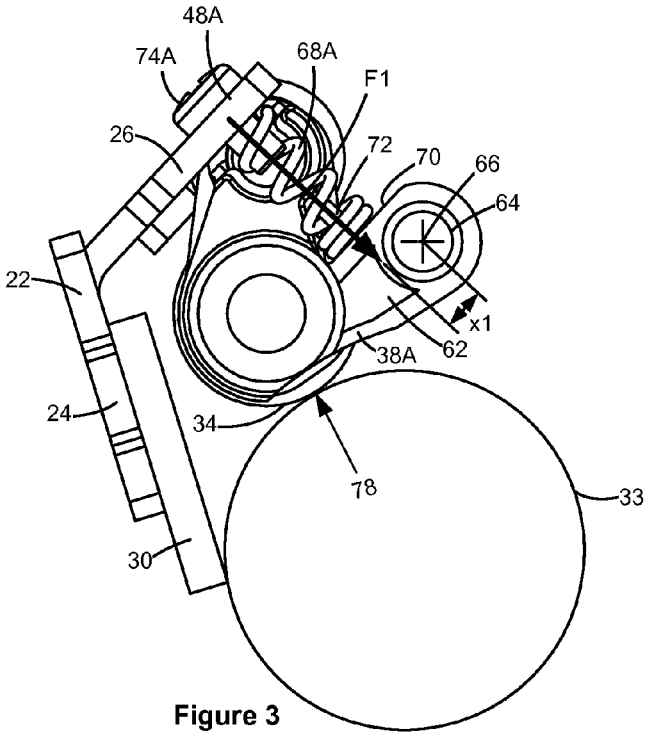
Figure 3 PRIOR ART
FIG. 3 is an end view of a bearing of the prior art charge roll mounting assembly shown in FIG. 1 positioned relative to the cleaner bracket.

With reference back to FIG. 3, in prior art assembly 20, the direction of the spring force F1 applied to ledges 70 by compression springs 68A, 68B is generally orthogonal to top plate 26 and away from rear plate 24. A lateral distance x1 between each pivot point 66 and the center of compression springs 68A, 68B is relatively small (2.2 mm) resulting in little leverage for compression springs 68A, 68B on ledges 70. As a result, the spring force of compression springs 68A, 68B is high in order to achieve sufficient nip force between charge roll 34 and photoconductive drum 33. The large spring force causes wide variations in the nip force between charge roll 34 and photoconductive drum 33 across multiple units of assembly 20 due to the size tolerances of the components of assembly 20 such as bearings 38A, 38B, charge roll 34 and cleaner bracket 22. In contrast, as shown in FIG. 7, the direction of the spring force F2 applied to ledges 170 by compression springs 168A, 168B is generally parallel to top plate 126 and toward rear plate 124. A lateral distance x2 between each pivot point 166 and the center of compression springs 168A, 168B is large in comparison with prior art assembly 20 (e.g., ~8.1 mm) resulting in significantly more leverage for compression springs 168A, 168B on ledges 170 without increasing the overall size of assembly 120 in comparison with prior art assembly 20. The increased leverage permits a reduction of the spring force of compression springs 168A, 168B in comparison with springs 68A, 68B. The reduced spring force also reduces the variations in the nip force between charge roll 134 and photoconductive drum 133 across multiple units of assembly 120.

Figure 1:
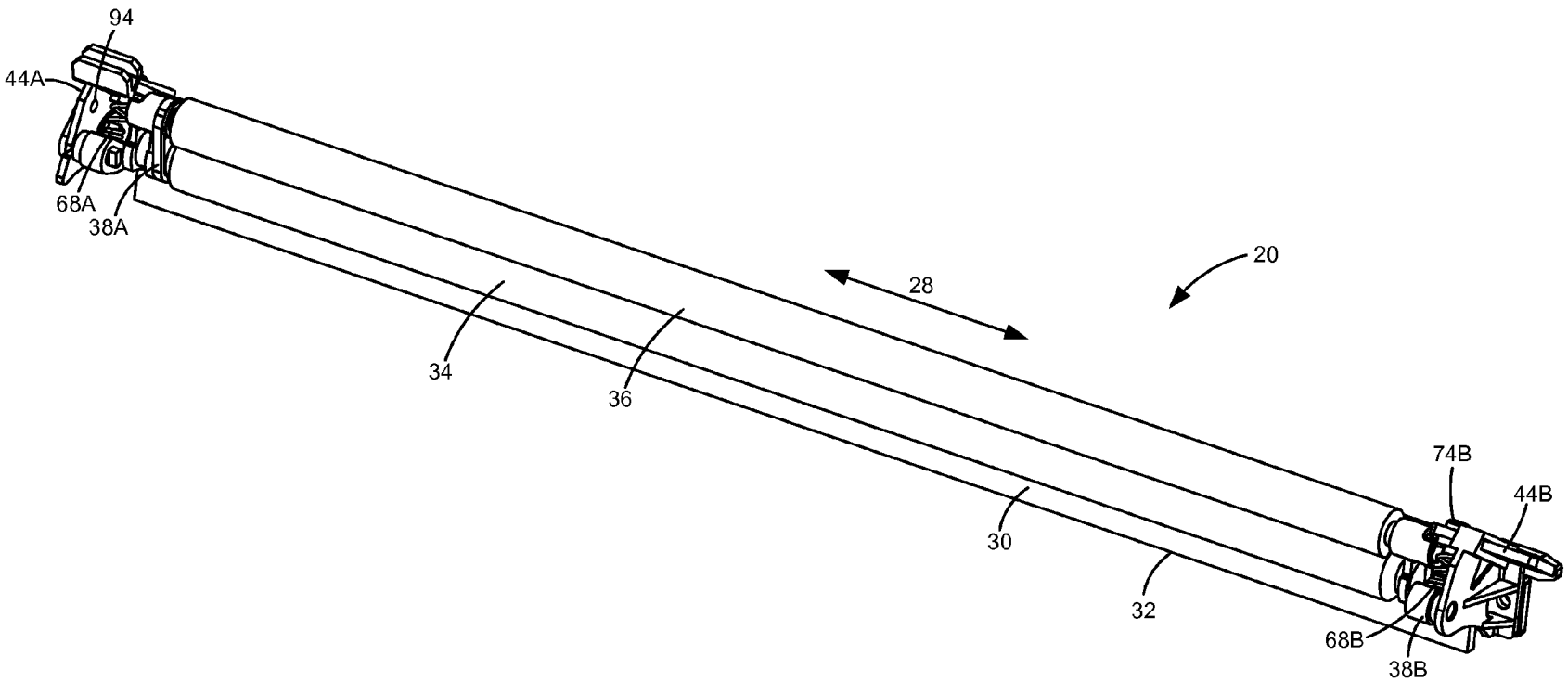
Figure 1 PRIOR ART
FIG. 1 is a perspective view of a prior art charge roll mounting assembly.
Figure 2:
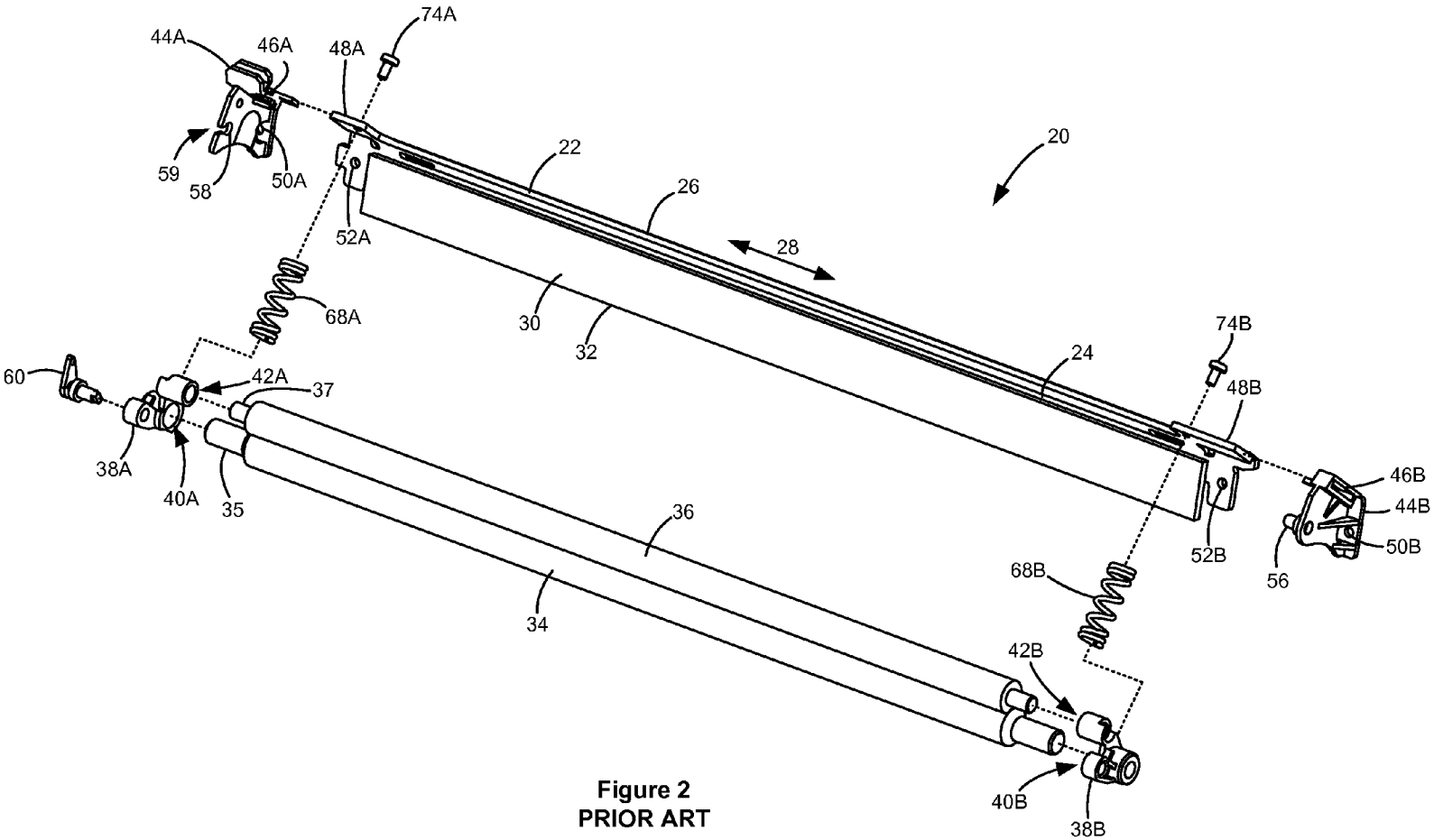
Figure 2 PRIOR ART
FIG. 2 is an exploded view of the prior art charge roll mounting assembly shown in FIG. 1.

With reference back to FIG. 2, zinc bearing retainers 44A, 44B of prior art assembly 20 are sufficiently stiff to reduce the vibration of bearings 38A, 38B across the wide range of nip forces between charge roll 34 and photoconductive drum 33; however, the zinc material of bearing retainers 44A, 44B is relatively expensive. With reference to FIG. 6, the reduced variation of the nip force between charge roll 134 and photoconductive drum 133 achieved by assembly 120 permits the elimination of the zinc bearing retainers 44A, 44B of prior art assembly 20 thereby reducing the cost of manufacture of assembly 120 in comparison with assembly 20. Bearing retainers 144A, 144B formed integrally with cleaner bracket 122 are sufficiently stiff to reduce vibration of bearings 138A, 138B.

Figure 8:
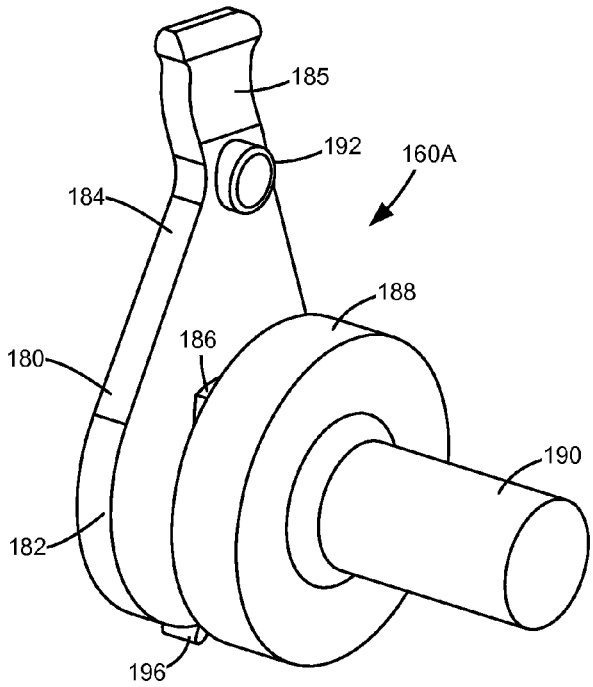
FIG. 8 is a perspective view of a locking pin of the charge roll mounting assembly shown in FIG. 5.

FIG. 8 shows locking pin 160A in greater detail. Locking pin 160B is substantially the same as locking pin 160A. Locking pins 160A, 160B may be composed of plastic. Locking pins 160A, 160B include a handle 180 that includes a relatively wide base 182 and a narrower flange 184 that extends from base 182. A rectangular prism shaped rod 186 extends away from base 182 of handle 180 in a direction generally orthogonal to handle 180. The rectangular cross section of rod 186 is defined by a height and a width. The height is too large to fit through a channel 159A, 159B at the front of each bearing retainer 144A, 144B that forms an entrance to guide slots 158A, 158B but the width is small enough to pass through channel 159A, 159B in order to permit locking pin 160A, 160B to be removed from its bearing retainer 144A, 144B as discussed below. Rod 186 leads to a cylindrical spacer 188. A cylindrical pin 190 extends from spacer 188 away from handle 180. Spacer 188 is concentric with rod 186 and pin 190 and has a diameter that is larger than the height and width of rod 186 and the diameter of pin 190. The portion of spacer 188 that extends radially beyond the outer surface of rod 186 is spaced from handle 180 by the length of rod 186 in the axial direction of charge roll 134. Flange 184 includes a snout 185 that extends from a distal end of flange 184 and bends slightly away from the direction that rod 186 and pin 190 extend from base 182. A retaining bump 192 extends slightly outward from flange 184 in the same direction as rod 186 and pin 190. With reference to FIGS. 5-8, pins 190 of locking pins 160A, 160B are positioned in openings 164 on arms 162 of bearings 138A, 138B. The engagement between pin 190 and opening 164 controls the position of pivot point 166 of each bearing 138A, 138B relative to its bearing retainer 144A, 144B. Rod 186 of each locking pin 160A, 160B is positioned in its guide slot 158A, 158B with bearing retainers 144A, 144B sandwiched between spacer 188 and base 182 of locking pin 160A, 160B to position locking pins 160A, 160B axially relative to bearing retainers 144A, 144B. Retaining bumps 192 extend into corresponding openings 194A, 194B in bearing retainers 144A, 144B that are positioned above guide slots 158A, 158B. The engagement between positioning bumps 192 and openings 194A, 194B prevent locking pins 160A, 160B from rotating relative to bearing retainers 144A, 144B. When a positioning bump 192 is positioned in an opening 194A or 194B, rod 186 is oriented with its height aligned with channel 159A, 159B such that rod 186 cannot slide out of guide slot 158A or 158B and locking pin 160A or 160B cannot separate from bearing retainer 144A or 144B.

Locking pins 160A, 160B are manually installable onto and removable from charge roll mounting assembly 120 to aid in the installation and removal of charge roll 134 and cleaner roll 136 onto and off of cleaner bracket 122. To remove either locking pin 160A, 160B, a user pulls snout 185 of flange 184 of handle 180 away from bearing retainer 144A or 144B until positioning bump 192 pulls out of opening 194A or 194B. The locking pin 160A or 160B is then free to rotate relative to bearing retainer 144A or 144B until the width of rod 186 is aligned with channel 159A or 159B so that rod 186 can slide out of guide slot 158A or 158B and locking pin 160A or 160B can separate from bearing retainer 144A or 144B. Pin 190 can then be removed from opening 164 on arm 162 of bearing 138A or 138B. To reengage locking pin 160A, 160B with bearing 138A, 138B, this sequence is reversed. In the example embodiment illustrated, locking pins 160A, 160B include an alignment tab 196 extending from the bottom of base 182. Alignment tab 196 provides a visual indicator to the user that locking pin 160A, 160B is in its locked position with retaining bump 192 aligned with opening 194A, 194B. For example, when retaining bump 192 is aligned with opening 194A, 194B, alignment tab 196 may point forward from assembly 120. In one embodiment, when retaining bump 192 is aligned with opening 194A, 194B, alignment tab 196 aligns with a visual indicator on the outer or front side of bearing retainer 144A, 144B such as a notch or mark so that the user can install locking pin 160A, 160B by aligning alignment tab 196 with the indicator on bearing retainer 144A, 144B.

Figure 4:
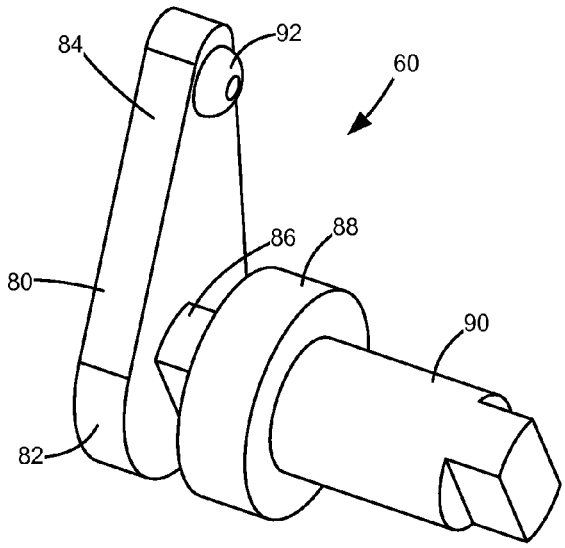
Figure 4 PRIOR ART
FIG. 4 is a perspective view of a locking pin of the prior art charge roll mounting assembly shown in FIG. 1.

Snout 185 provides an improved touch point for the user in comparison with flange 84 of locking pin 60 shown in FIG. 4.

Specifically, the bend of snout 185 away from bearing retainer 144A or 144B allows the user to more easily grasp flange 184. Further, the edges of retaining bump 192 are sharper (closer to a right angle) than those of retaining bump 92 of assembly 20, which have a larger radius of curvature. The decreased radius of curvature of the edges of retaining bump 192 makes positioning bump 192 less prone to unintentionally disengage from opening 194A, 194B. As a result, the sharper edges of retaining bump 192 make the engagement between retaining bump 192 and opening 194A, 194B more secure than the engagement between retaining bump 92 and opening 94 of bearing retainer 44A while snout 185 makes locking pin 160A, 160B more easy to install and remove than locking pin 60 despite the improved engagement between retaining bump 192 and opening 194A, 194B.

Figure 9:
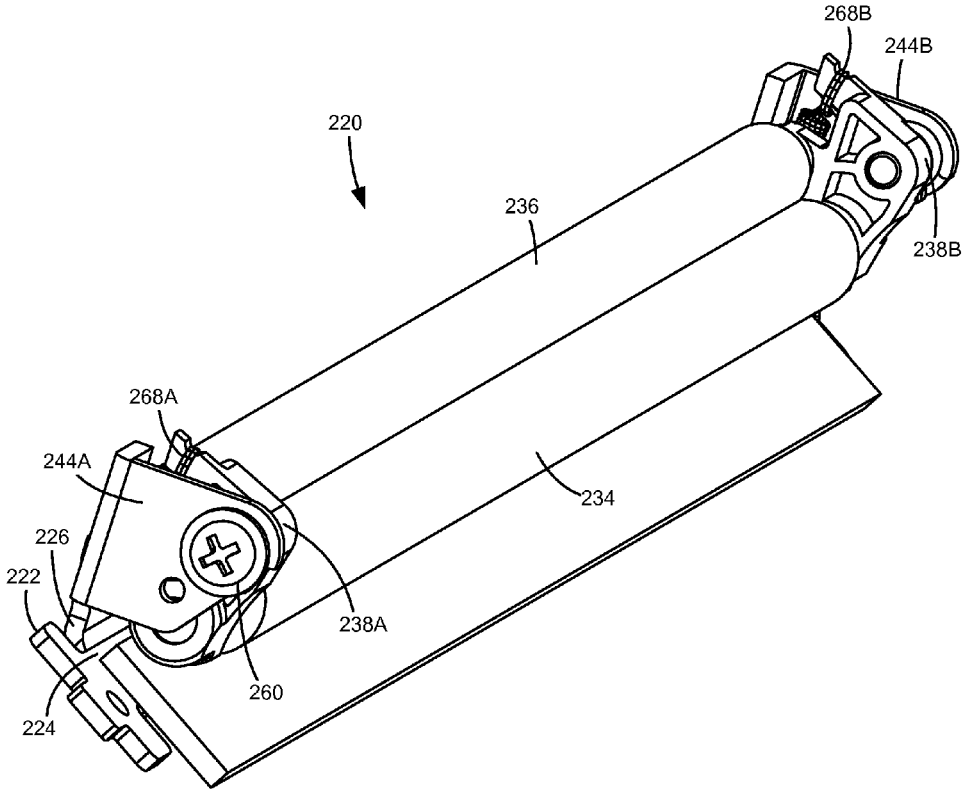
FIG. 9 is a perspective view of a charge roll mounting assembly according to another example embodiment.

FIG. 9 shows a charge roll mounting assembly 220 according to another example embodiment. Assembly 220 includes a cleaner bracket 222 having a charge roll 234 and a cleaner roll 236 mounted thereto by bearings 238A, 238B. Bearings 238A, 238B, which retain and support the ends of the shafts of charge roll 234 and cleaner roll 236, are mounted to bearing retainers 244A, 244B formed on the ends of cleaner bracket 222. Cleaner bracket 222 includes a rear plate 224 and a top plate 226 as discussed above.

Figure 10:
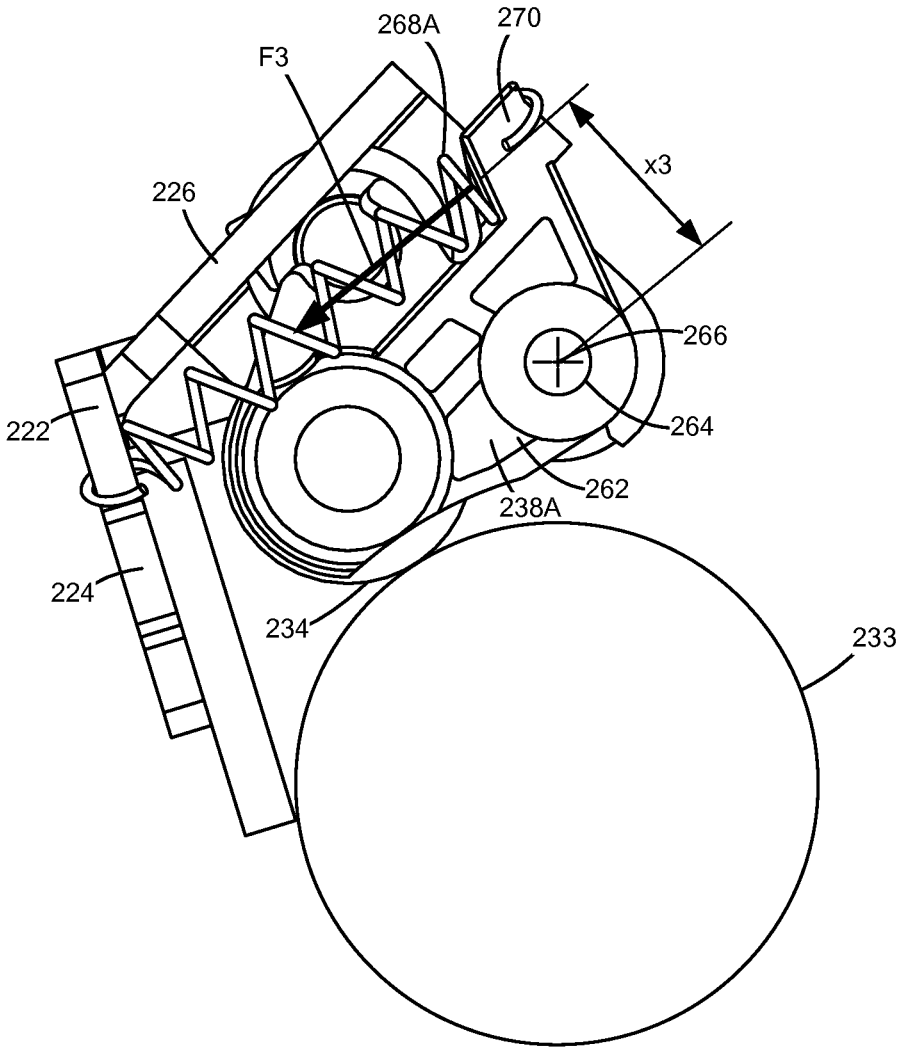
FIG. 10 is an end view of a bearing of the charge roll mounting assembly shown in FIG. 9 positioned relative to a cleaner bracket.

FIG. 10 shows an end view of bearing 238A positioned relative to cleaner bracket 222 with bearing retainer 244A removed to more clearly illustrate the features of bearing 238A. Bearing 238B is substantially the same as bearing 238A except that bearing 238B is a mirror image of bearing 238A. Instead of compression springs, a pair of extension springs 268A, 268B bias bearings 238A, 238B toward a photoconductive drum 233 (in a counterclockwise direction as viewed in FIG. 10) about a pivot point 266. Each bearing 238A, 238B includes a charge roll opening and a cleaner roll opening as discussed above. Each bearing 238A, 238B also includes an arm 262 that extends forward, away from rear plate 224 of cleaner bracket 222, from the portion of the bearing 238A, 238B that forms the charge roll opening. An opening 264 is formed in a distal end of each arm 262. Pivot point 266 is formed at the center of opening 264. A tab 270 extends upward from a distal end of arm 262 generally perpendicular to a line formed between the center of the charge roll opening and opening 264 in arm 262. Extension springs 268A, 268B are mounted at one end to tab 270 and at another end to rear plate 224. The force from extension springs 268A, 268B biases charge roll 234 against the photoconductive drum.

As shown in FIG. 10, the direction of the spring force F3 applied to tabs 270 by extension springs 268A, 268B is roughly parallel to top plate 226 and toward rear plate 224. A lateral distance x3 between each pivot point 266 and the center of extension springs 268A, 268B is large in comparison with prior art assembly 20 (e.g., ~8.7 mm) resulting in significantly more leverage for extension springs 268A, 268B on tabs 270. The increased leverage permits a reduction of the spring force of extension springs 268A, 268B in comparison with compression springs 68A, 68B. As discussed above, the reduced spring force also reduces the variations in the nip force between charge roll 234 and photoconductive drum 233 across multiple units of assembly 220. In another embodiment, the charge roll mounting assembly includes a torsion spring or a leaf spring that biases the charge roll against the photoconductive drum.

With reference to FIGS. 9 and 10, in the embodiment illustrated, each bearing retainer 244A, 244B includes an opening that aligns with a corresponding opening 264 of arm 262 of each bearing 238A, 238B. A screw 260 passes through the openings of each bearing retainer 244A, 244B and bearing 238A, 238B to connect each bearing 238A, 238B to its respective bearing retainer 244A, 244B. Each screw 260 includes a threaded portion proximate to the screw head that attaches screw 260 to its bearing retainer 244A, 244B and an unthreaded portion (like pin 190 discussed above) at its distal end that passes through the corresponding bearing 238A, 238B and controls the position of pivot point 266 of the bearing 238A, 238B relative to its bearing retainer 244A, 244B. Screws 260 are manually installable and removable to aid in the installation and removal of charge roll 234 and cleaner roll 236 onto and off of cleaner bracket 222.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for an electrophotographic image forming device, comprising:

a charge roll having a shaft that includes a pair of axial ends, the charge roll having an axial length between the axial ends of the shaft;

a bracket extending along the axial length of the charge roll;

a first bearing retainer on a first axial end of the bracket and a second bearing retainer on a second axial end of the bracket;

a first bearing pivotally mounted to the first bearing retainer and a second bearing pivotally mounted to the second bearing retainer, each of the first and second bearings having a charge roll opening that supports a respective axial end of the shaft of the charge roll; and a first biasing member acting on the first bearing and a second biasing member acting on the second bearing, the first and second biasing members biasing the charge roll toward an operative position for charging an outer surface of a photoconductive drum, a direction of force from the first biasing member on the first bearing and from the second biasing member on the second bearing is toward the bracket.

2. The assembly of claim 1, wherein the bracket includes a rear plate positioned rearward from the charge roll and the direction of force is toward the rear plate.

3. The assembly of claim 2, wherein the bracket includes a top plate positioned above the charge roll, the top plate extends from a top portion of the rear plate in a forward direction away from the rear plate, the bracket includes a first tab that extends downward from a distal end of the top plate at the first axial end of the bracket and a second tab that extends downward from a distal end of the top plate at the second axial end of the bracket, wherein the first biasing member includes a first compression spring positioned against the first tab and the second biasing member includes a second compression spring positioned against the second tab.

4. The assembly of claim 2, further comprising a cleaner blade extending in a cantilevered manner from a bottom portion of the rear plate for cleaning the outer surface of the photoconductive drum.

5. The assembly of claim 1, wherein the first and second bearing retainers are formed integrally with the bracket.

6. The assembly of claim 1, wherein the first bearing and the second bearing each include an arm extending forward away from the charge roll and a pivot point of each bearing is formed at a distal end of each arm, a flange extends upward from each arm at the distal end of each arm, the first biasing member includes a first extension spring having a first end mounted to the flange of the first bearing and a second end mounted to the bracket and the second biasing member includes a second extension spring having a first end mounted to the flange of the second bearing and a second end mounted to the bracket.

7. The assembly of claim 1, further comprising a flange extending upward from each bearing, each flange forming a ledge on a front face of the flange, wherein the first biasing member includes a first compression spring positioned against the ledge of the first bearing and the second biasing member includes a second compression spring positioned against the ledge of the second bearing.

8. The assembly of claim 7, wherein the flange of the first bearing extends upward from a portion of the first bearing having the charge roll opening of the first bearing and the flange of the second bearing extends upward from a portion of the second bearing having the charge roll opening of the second bearing.

9. The assembly of claim 1, wherein the first biasing member and the second biasing member are positioned above the charge roll.

10. An assembly for an electrophotographic image forming device, comprising:

a photoconductive drum;

a charge roll having a shaft that includes a pair of axial ends, the charge roll having an axial length between the axial ends of the shaft;

a bracket extending along the axial length of the charge roll, the bracket having a rear plate positioned rearward from the charge roll and a top plate positioned above the charge roll, the top plate extending from a top portion of the rear plate in a forward direction away from the rear plate;

a first bearing retainer on a first axial end of the bracket and a second bearing retainer on a second axial end of the bracket;

a first bearing pivotally mounted to the first bearing retainer and positioned on an inner axial side of the first bearing retainer and a second bearing pivotally mounted to the second bearing retainer and positioned on an inner axial side of the second bearing retainer, each of the first and second bearings having a charge roll opening that supports a respective axial end of the shaft of the charge roll; and a first biasing member in contact with the first bearing and a second biasing member in contact with the second bearing, the first and second biasing members biasing the charge roll toward an outer surface of the photoconductive drum, a direction of force from the first biasing member on the first bearing and from the second biasing member on the second bearing is toward the rear plate.

11. The assembly of claim 10, wherein the bracket includes a first tab that extends downward from a distal end of the top plate at the first axial end of the bracket and a second tab that extends downward from a distal end of the top plate at the second axial end of the bracket, wherein the first biasing member includes a first compression spring positioned against the first tab and the second biasing member includes a second compression spring positioned against the second tab.

12. The assembly of claim 10, wherein the first and second bearing retainers are formed integrally with the bracket.

13. The assembly of claim 10, wherein the first bearing and the second bearing each include an arm extending forward away from the charge roll and a pivot point of each bearing is formed at a distal end of each arm, a flange extends upward from each arm at the distal end of each arm, the first biasing member includes a first extension spring having a first end mounted to the flange of the first bearing and a second end mounted to the bracket and the second biasing member includes a second extension spring having a first end mounted to the flange of the second bearing and a second end mounted to the bracket.

14. The assembly of claim 10, further comprising a flange extending upward from each bearing, each flange forming a ledge on a front face of the flange, wherein the first biasing member includes a first compression spring positioned against the ledge of the first bearing and the second biasing member includes a second compression spring positioned against the ledge of the second bearing.

15. The assembly of claim 14, wherein the flange of the first bearing extends upward from a portion of the first bearing having the charge roll opening of the first bearing and the flange of the second bearing extends upward from a portion of the second bearing having the charge roll opening of the second bearing.

16. The assembly of claim 10, wherein the first biasing member and the second biasing member are positioned above the charge roll.

17. The assembly of claim 10, further comprising a cleaner blade extending in a cantilevered manner from a bottom portion of the rear plate, a free end of the cleaner blade is positioned to contact the outer surface of the photoconductive drum.

* * * * *